US010951991B2

(12) United States Patent
Bogdanov et al.

(10) Patent No.: US 10,951,991 B2
(45) Date of Patent: Mar. 16, 2021

(54) LOUDSPEAKER

(71) Applicant: Paradigm Electronics Inc., Mississauga (CA)

(72) Inventors: Oleg Bogdanov, Toronto (CA); Jayson W. Conroy, Burlington (CA); Oliver Donald Munroe, Le Mans (FR)

(73) Assignee: Paradigm Electronics Inc.

( * ) Notice: Subject to any disclaimer, the term of this patent is extended or adjusted under 35 U.S.C. 154(b) by 0 days.

(21) Appl. No.: 16/801,807

(22) Filed: Feb. 26, 2020

(65) Prior Publication Data

US 2020/0275212 A1 Aug. 27, 2020

Related U.S. Application Data

(60) Provisional application No. 62/811,295, filed on Feb. 27, 2019.

(51) Int. Cl.

| | |
|---|---|
| ***H04R 9/02*** | (2006.01) |
| ***H04R 1/24*** | (2006.01) |
| ***H04R 9/06*** | (2006.01) |

(52) U.S. Cl.

CPC ..... *H04R 9/025* (2013.01); *H04R 1/24* (2013.01); *H04R 9/06* (2013.01); *H04R 2209/022* (2013.01)

(58) Field of Classification Search

CPC ..... H04R 9/063

See application file for complete search history.

(56) References Cited

U.S. PATENT DOCUMENTS

| | | | | |
|---|---|---|---|---|
| 4,783,824 | A * | 11/1988 | Kobayashi | H04R 9/025 381/402 |
| 5,548,657 | A | 8/1996 | Fincham | |
| 5,802,191 | A | 9/1998 | Guenther | |
| 6,269,168 | B1 * | 7/2001 | Tagami | H04R 9/025 381/412 |
| 6,563,932 | B2 | 5/2003 | Cork | |
| 6,647,122 | B1 | 11/2003 | Jones | |
| 6,963,651 | B2 | 11/2005 | Peng | |
| 6,980,664 | B2 | 12/2005 | Goller | |
| 7,302,076 | B2 | 11/2007 | Guenther | |
| 9,232,391 | B2 | 1/2016 | Wang et al. | |

(Continued)

FOREIGN PATENT DOCUMENTS

EP 1278397 A2 1/2003

*Primary Examiner* — Fan S Tsang
*Assistant Examiner* — Angelica M McKinney
(74) *Attorney, Agent, or Firm* — Hovey Williams LLP

(57) ABSTRACT

A coaxial loudspeaker comprises a low frequency driver, a high frequency driver, and a magnetic circuit. The low frequency driver is configured to generate low frequency sounds and includes a first voice coil. The high frequency driver, coaxially aligned with the low frequency driver, is configured to generate high frequency sounds relative to the low frequency driver and includes a second voice coil. The magnetic circuit includes a first magnet configured to generate a first magnetic field, a second magnet configured to generate a second magnetic field, a first magnetic gap including magnetic flux from the first magnet and the second magnet in which the first voice coil is positioned, and a second magnetic gap including magnetic flux from the first magnet and the second magnet in which the second voice coil is positioned.

12 Claims, 7 Drawing Sheets

(56) References Cited

U.S. PATENT DOCUMENTS

| | | | | |
|---|---|---|---|---|
| 9,538,290 | B2 | 1/2017 | Papp | |
| 2004/0071307 | A1* | 4/2004 | Chang | H04R 9/06 381/396 |
| 2006/0062422 | A1* | 3/2006 | Ono | H04R 31/003 381/424 |
| 2009/0214075 | A1* | 8/2009 | Inoue | H04R 9/045 381/413 |
| 2011/0170736 | A1* | 7/2011 | Li | H04R 9/06 381/401 |
| 2020/0221214 | A1* | 7/2020 | Mordechai | H04R 9/06 |

* cited by examiner

LOUDSPEAKER

RELATED APPLICATIONS

The current patent application claims priority benefit, with regard to all common subject matter, to U.S. Provisional Application Ser. No. 62/811,295, entitled "LOUDSPEAKER", filed Feb. 27, 2019. The listed application is hereby incorporated by reference, in its entirety, into the current patent application.

BACKGROUND

A coaxial loudspeaker includes two or more drivers that are centered along the same axis. Each driver is configured to generate sound for a particular frequency range. For example, the coaxial loudspeaker may include a first driver that is configured to generate low frequency sound ranging from approximately 40 Hertz (Hz) to approximately 2,000 Hz. The coaxial loudspeaker may include a second driver that is configured to generate high frequency sound ranging from approximately 2,000 Hz to approximately 20,000 Hz. Each driver includes a diaphragm that moves to generate sound waves, a voice coil that oscillates to move the diaphragm, and a magnetic circuit that generates a magnetic field in which the voice coil oscillates. One challenge in constructing a coaxial loudspeaker is placing all of the components of each driver in a confined space such that the drivers remain coaxial and operate efficiently.

SUMMARY OF THE INVENTION

Embodiments of the current invention provide a distinct advance in the art of coaxial loudspeaker design. Specifically, embodiments of the current invention provide a coaxial loudspeaker with a low frequency driver and a high frequency driver that share a magnetic circuit—leading to increased efficiency, lower part count, more compact size, and placement of the low frequency driver and the high frequency driver closer to one another. The coaxial loudspeaker comprises a low frequency driver, a high frequency driver, and a magnetic circuit. The low frequency driver is configured to generate low frequency sounds and includes a first voice coil. The high frequency driver is coaxially aligned with the low frequency driver and is configured to generate high frequency sounds relative to the low frequency driver. The high frequency driver includes a second voice coil. The magnetic circuit is shared by the low frequency driver and the high frequency driver and includes a cup, a first magnet, a second magnet, a pole piece, a plate, a first magnetic gap, and a second magnetic gap. The cup includes a hollow cylindrical side wall and a circular bottom wall connected to one end of the side wall. The first magnet is configured to generate a first magnetic field and is positioned within the cup in contact with the bottom wall. The second magnet is configured to generate a second magnetic field is positioned within the cup axially spaced apart from the first magnet. The pole piece is positioned within the cup. The pole piece includes a central ring and a lower flange connected to the central ring and extending radially outward. The central ring is positioned radially inward from the second magnet. The plate has a ring shape and is positioned within the cup in contact with the second magnet and radially outward from the central ring. The first magnetic gap is located between the lower flange and the side wall of the cup. The first voice coil is positioned in the first magnetic gap. The second magnetic gap is located between the central ring and the plate. The second voice coil is positioned in the second magnetic gap.

Another embodiment of the current invention provides a coaxial loudspeaker comprising a low frequency driver, a high frequency driver, and a magnetic circuit. The low frequency driver is configured to generate low frequency sounds and includes a first voice coil, a first collar, a first diaphragm, a first surround, and a first spider. The first voice coil is mounted on the first collar. The first diaphragm is frusto-conically shaped and connected to the first collar such that motion of the first voice coil causes motion of the first diaphragm. The first surround is configured to reduce radial motion of the first diaphragm. The first spider is configured to reduce radial motion of the first collar. The high frequency driver is coaxially aligned with the low frequency driver and is configured to generate high frequency sounds relative to the low frequency driver. The high frequency driver includes a second voice coil, a second collar, a second diaphragm, and a second surround. The second voice coil is mounted on the second collar. The second diaphragm is dome shaped and connected to the second collar such that motion of the second voice coil causes motion of the second diaphragm. The second surround is configured to reduce radial motion of the second diaphragm and the second voice coil. The magnetic circuit is shared by the low frequency driver and the high frequency driver and includes a cup, a first magnet, a second magnet, a pole piece, a plate, a first magnetic gap, and a second magnetic gap. The cup includes a hollow cylindrical side wall and a circular bottom wall connected to one end of the side wall. The first magnet is configured to generate a first magnetic field and is positioned within the cup in contact with the bottom wall. The second magnet is configured to generate a second magnetic field is positioned within the cup axially spaced apart from the first magnet. The pole piece is positioned within the cup. The pole piece includes a central ring and a lower flange connected to the central ring and extending radially outward. The central ring is positioned radially inward from the second magnet. The plate has a ring shape and is positioned within the cup in contact with the second magnet and radially outward from the central ring. The first magnetic gap is located between the lower flange and the side wall of the cup. The first voice coil is positioned in the first magnetic gap. The second magnetic gap is located between the central ring and the plate. The second voice coil is positioned in the second magnetic gap.

Yet another embodiment of the current invention provides a coaxial loudspeaker comprising a low frequency driver and a high frequency driver. The low frequency driver is configured to generate low frequency sounds and includes a frusto-conically shaped first diaphragm with a circumferential inner edge and a circumferential outer edge. The high frequency driver is coaxially aligned with the low frequency driver and configured to generate high frequency sounds relative to the low frequency driver. The high frequency driver includes a dome-shaped second diaphragm with a circumferential edge, and an annular waveguide with a circumferential inner edge adjacent to the second diaphragm and a circumferential outer edge adjacent to the first diaphragm. The waveguide in combination with the first diaphragm forms an acoustic waveguide for the high frequency driver.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
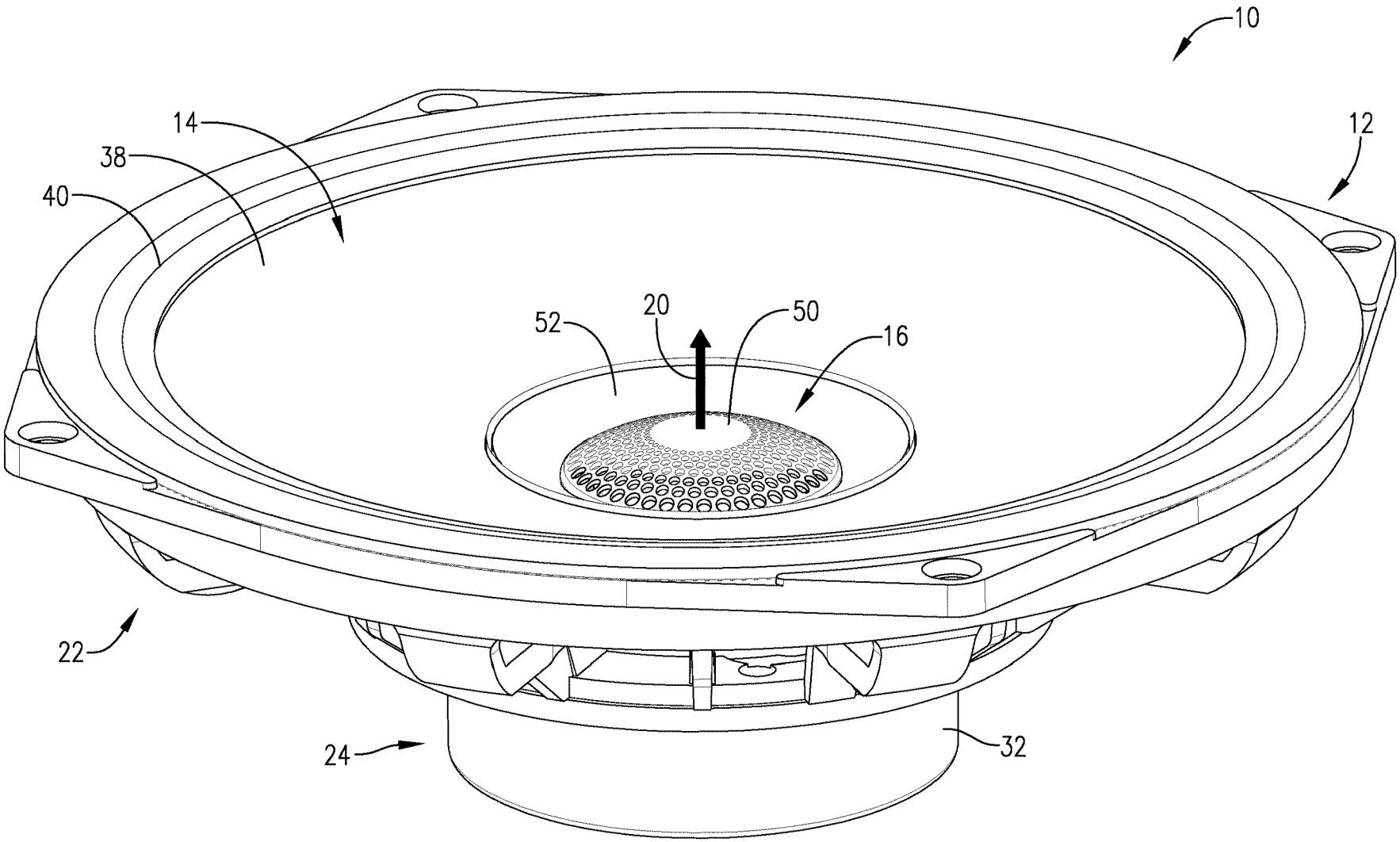
FIG. 1 is an upper perspective view of a coaxial loudspeaker constructed in accordance with various embodiments of the invention.
Figure 2:
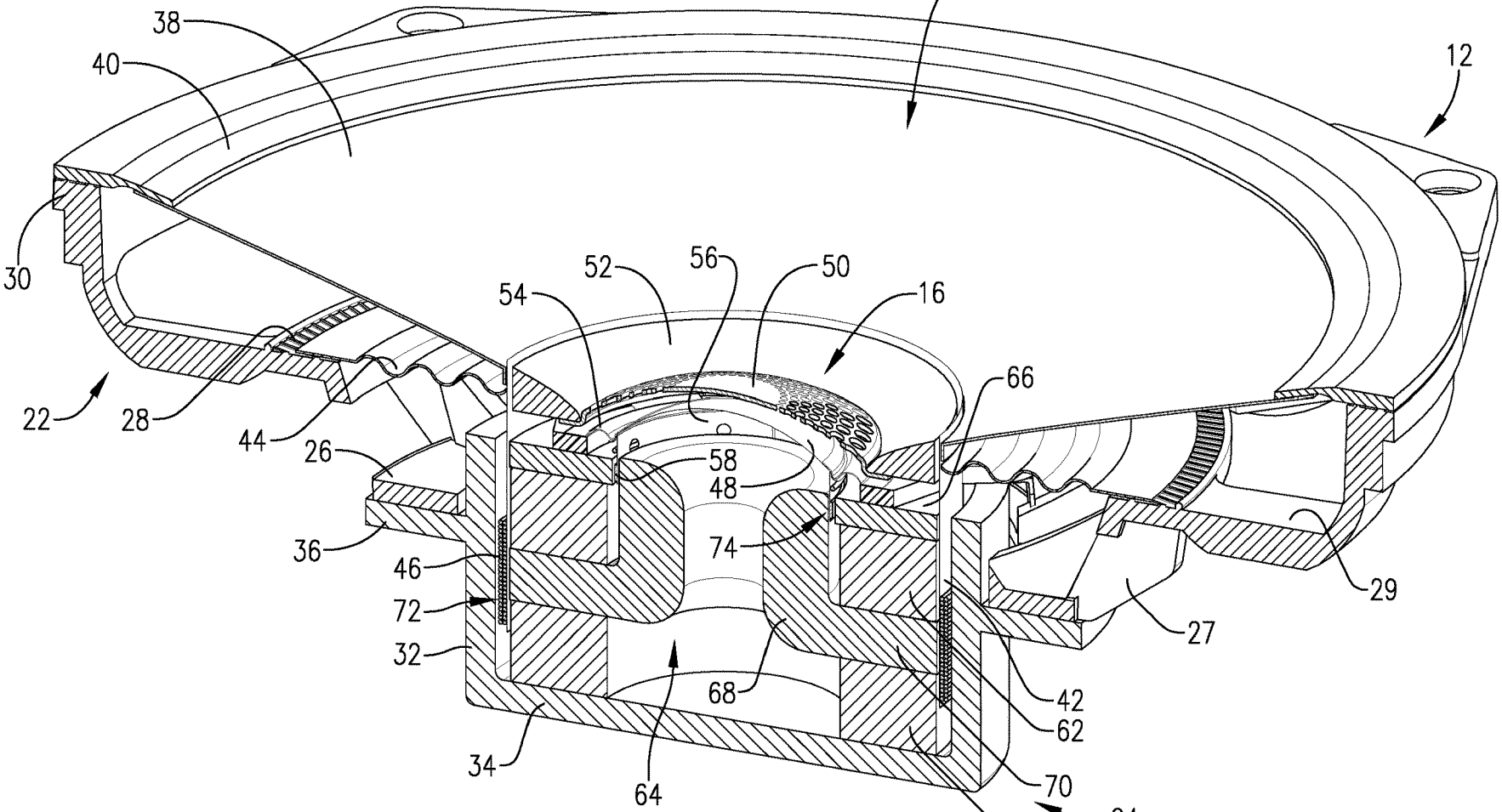
FIG. 2 is a cross-sectional upper perspective view of the coaxial loudspeaker of FIG. 1, taken through a vertical plane through a central axis of the coaxial loudspeaker.
Figure 6:
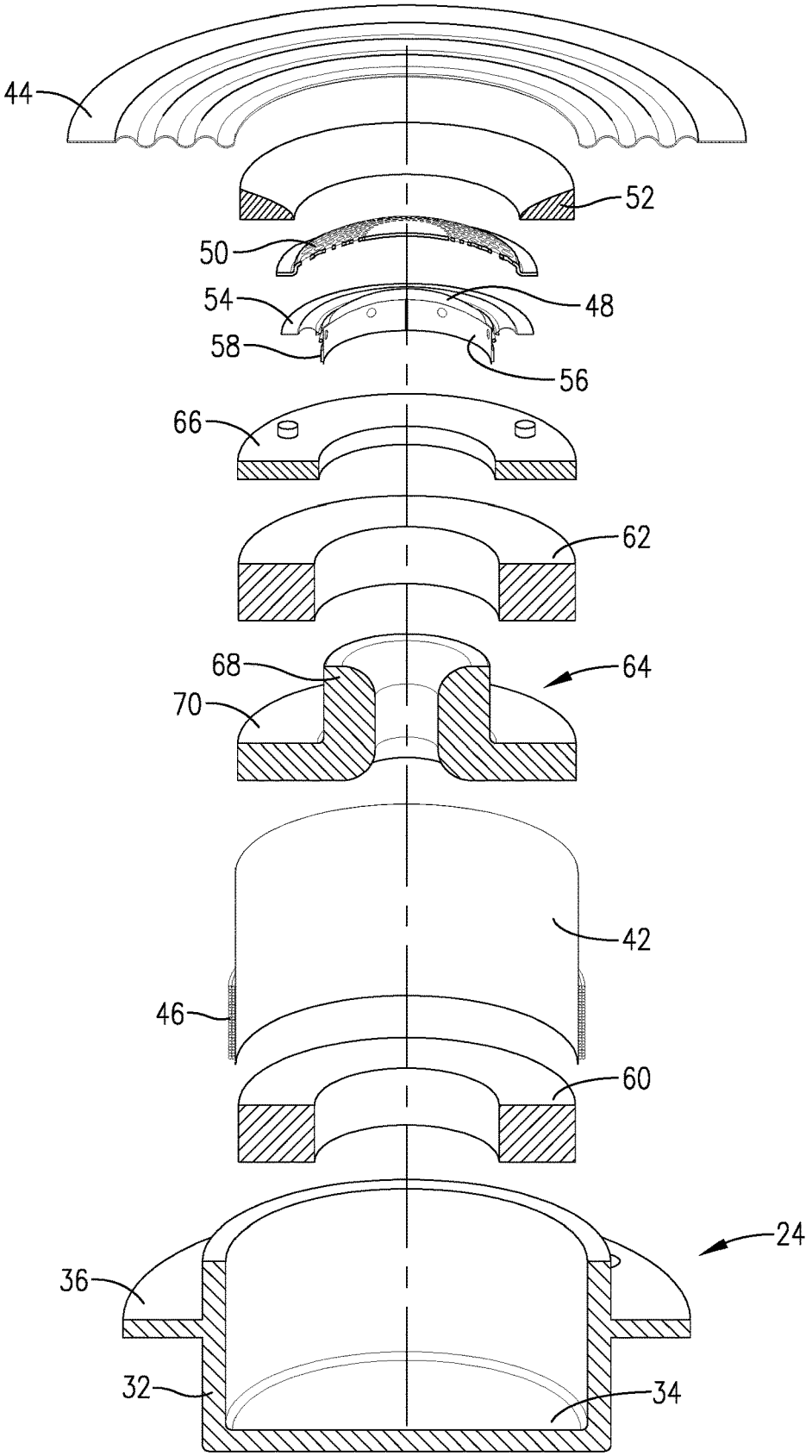
Figure 7:
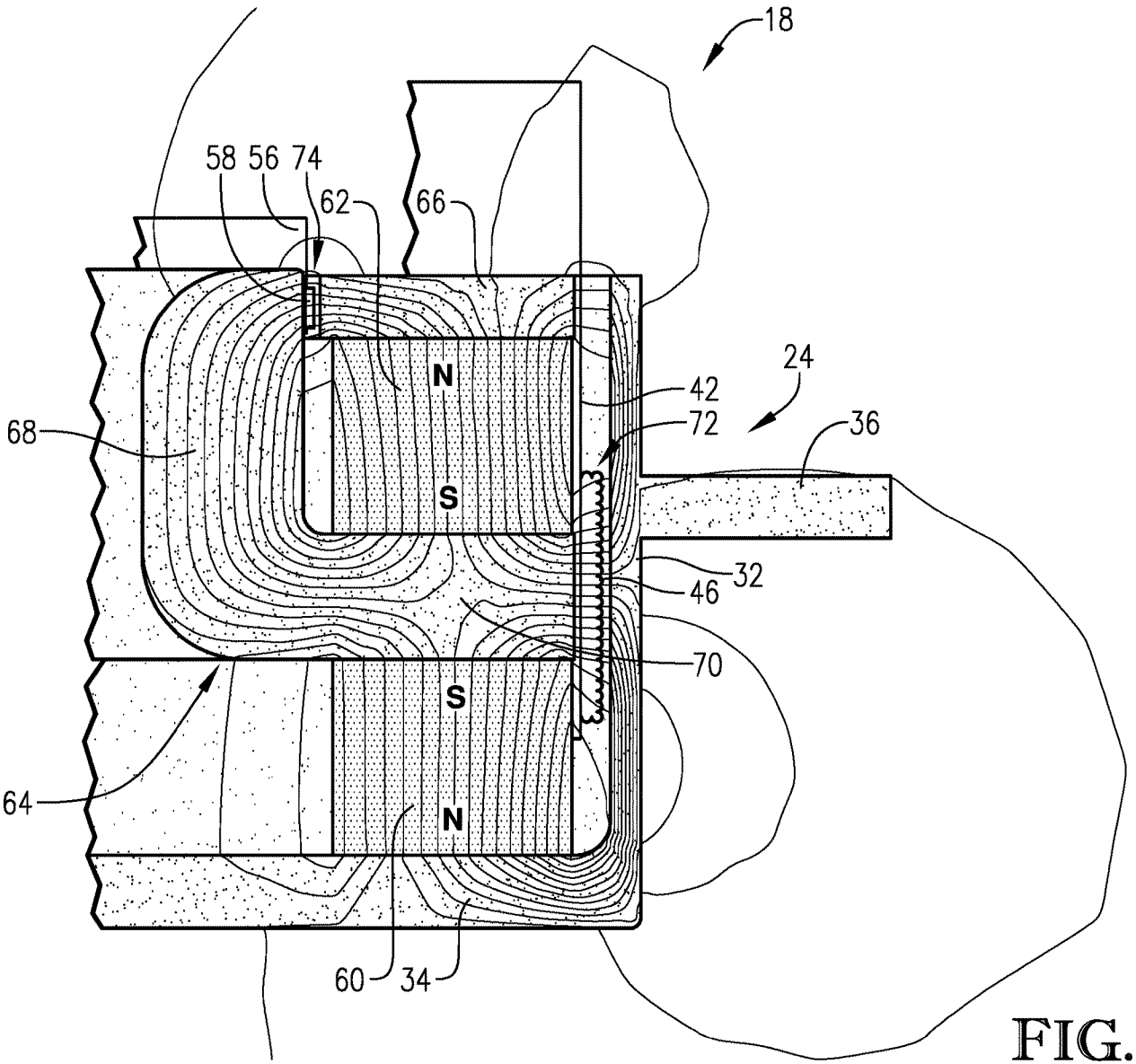

FIG. 6 is an upper perspective, exploded, cross-sectional view of a portion of the coaxial loudspeaker of FIG. 1, taken through a vertical plane through a central axis of the coaxial loudspeaker; and FIG. 7 is a partial schematic, cross-sectional side view of a coaxial loudspeaker constructed in accordance with various embodiments of the invention, taken through a vertical plane bisecting a central axis of a magnetic circuit of the coaxial loudspeaker.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

A coaxial loudspeaker 10, constructed in accordance with various embodiments of the current invention, is shown in FIGS. 1-7 and broadly comprises a frame 12, a low frequency driver 14, a high frequency driver 16, and a magnetic circuit 18. The coaxial loudspeaker 10 has, among other improvements, a more compact size—specifically, a decreased depth. This feature gives the coaxial loudspeaker 10 a low profile and allows the coaxial loudspeaker 10 to be utilized in situations or environments that have a limited depth. For example, the coaxial loudspeaker 10 may be utilized in vehicles, particularly in doors of vehicles, in ceilings or walls of buildings and houses, in bookshelf speaker systems, in portable speaker systems, and the like The components of the coaxial loudspeaker 10 are generally aligned with one another along and centered on a central axis 20. The frame 12 provides structural support to retain the components of the low frequency driver 14 and the high frequency driver 16. The frame 12 includes a basket 22 and a cup 24. The basket 22 includes first, second, and third rings 26, 28, 30, each being centered on the axis 20. The first ring 26 has a first radially-inner diameter and a first radially-outer diameter. The second ring 28 is radially outside of and axially spaced from the first ring 26 and has a second radially-inner diameter and a second radially-outer diameter. The second inner diameter is greater than the first outer diameter. The third ring 30 is radially outside of and axially spaced from the second ring 28. The third ring 30 has a third radially-inner diameter and a third radially-outer diameter. The third inner diameter is greater than the second outer diameter.

A plurality of first spokes 27, radially oriented and circumferentially spaced, connect the first ring 26 to the second ring 28. A plurality of second spokes 29, radially oriented and circumferentially spaced, connect the second ring 28 to the third ring 30. The cup 24 includes a cylindrical side wall 32, a circular bottom wall 34, and a side flange 36. The cup 24 may be formed from magnetically permeable material. The bottom wall 34 is connected to an axial end margin of the side wall 32. An axially-opposing end margin 37 of the side wall 32 is substantially uncovered, exposing an inner cavity of the cup 24.

The side flange 36 is disc-shaped, positioned approximately at a midpoint axially along an outer surface of the side wall 32, and extends radially outward therefrom. The side flange 36 may be coupled to the first ring 26 to removably or permanently couple or assemble the cup 24 to the basket 22. Upon assembly, an axially-forward surface of the side flange 36 may be adjacent to and/or flush against an axially-rearward surface of the first ring 26.

Figure 3:
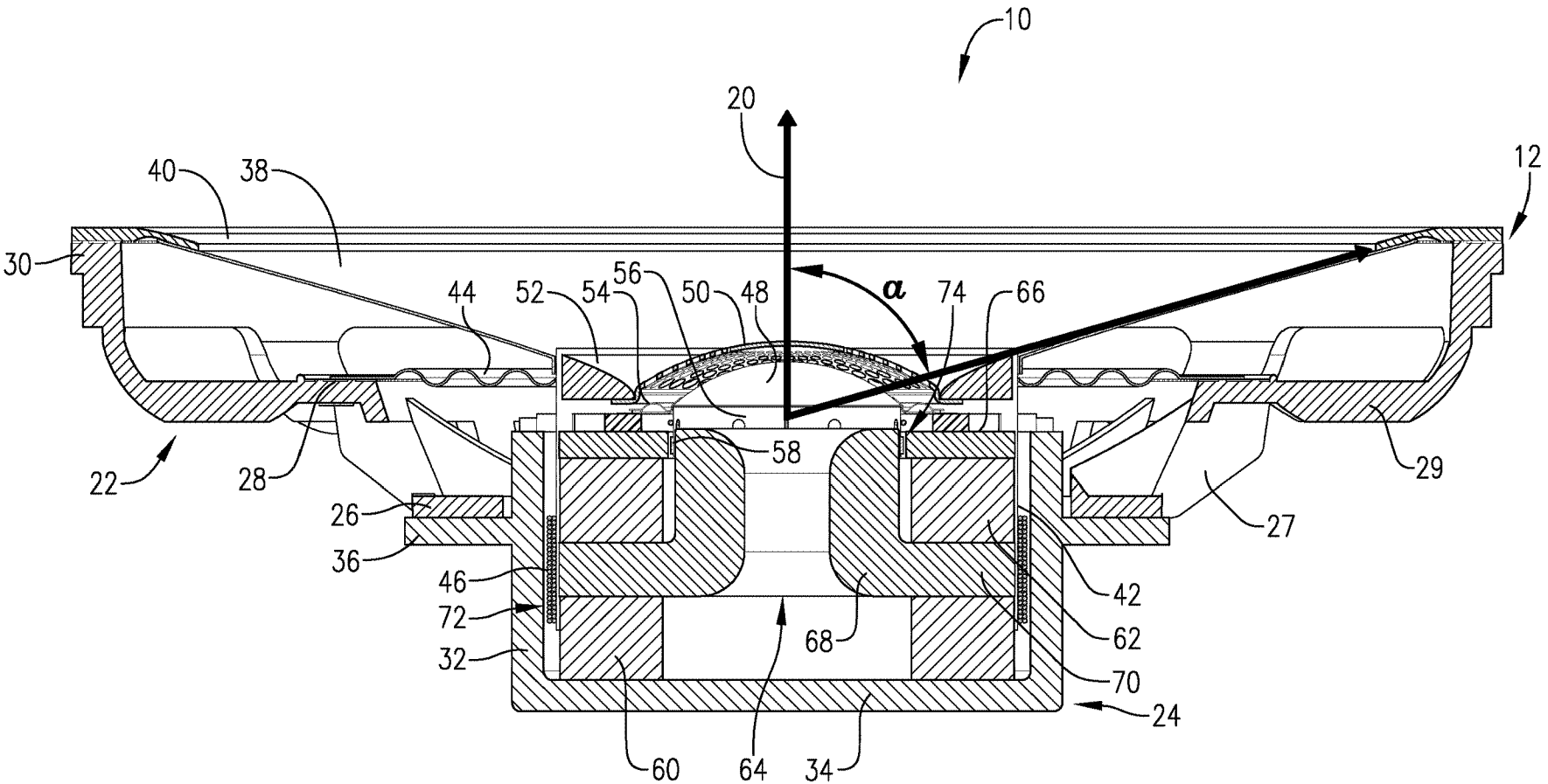
FIG. 3 is a cross-sectional side view of the coaxial loudspeaker of FIG. 2.
Figure 4:
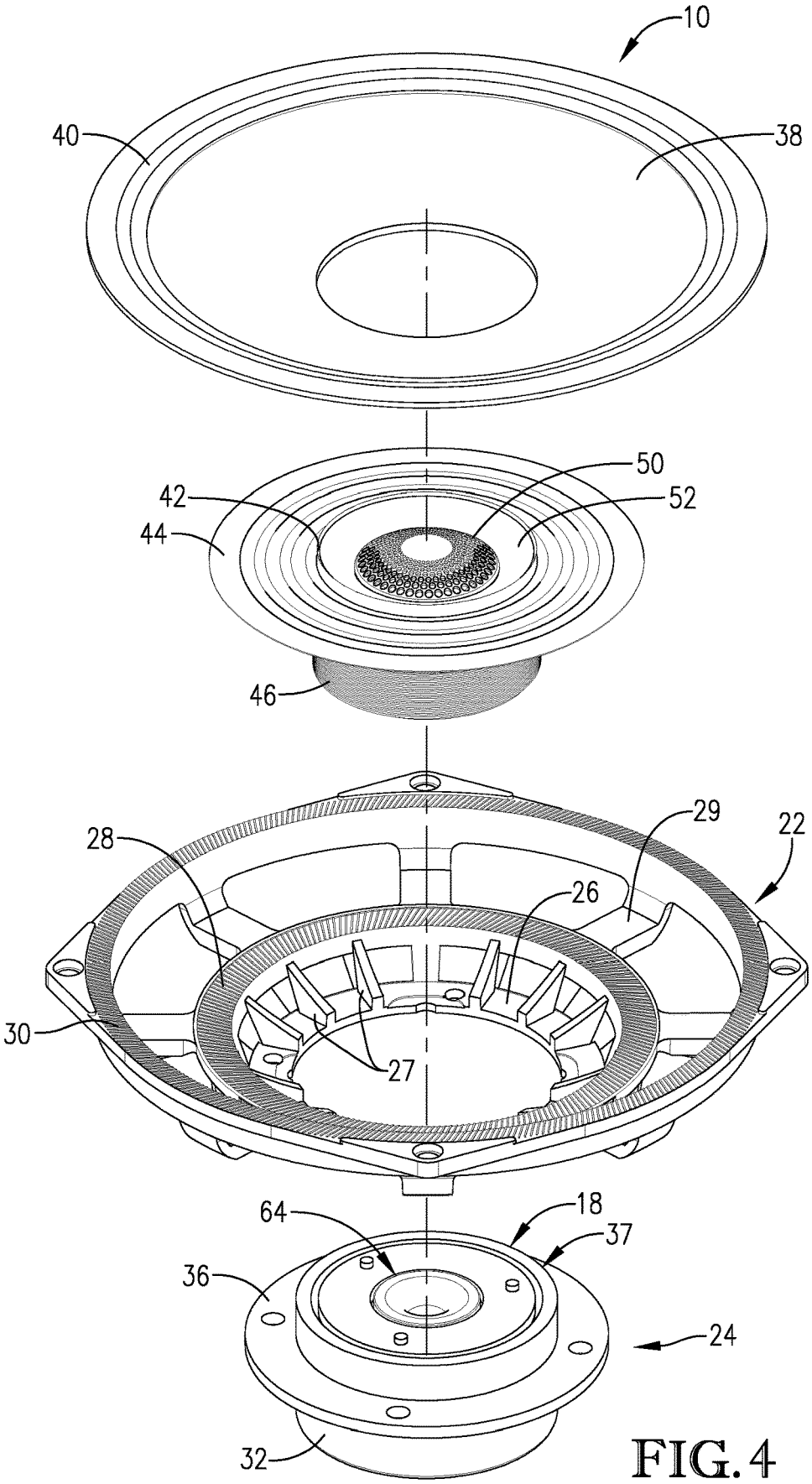
FIG. 4 is an upper perspective exploded view of the coaxial loudspeaker of FIG. 1.
Figure 5:
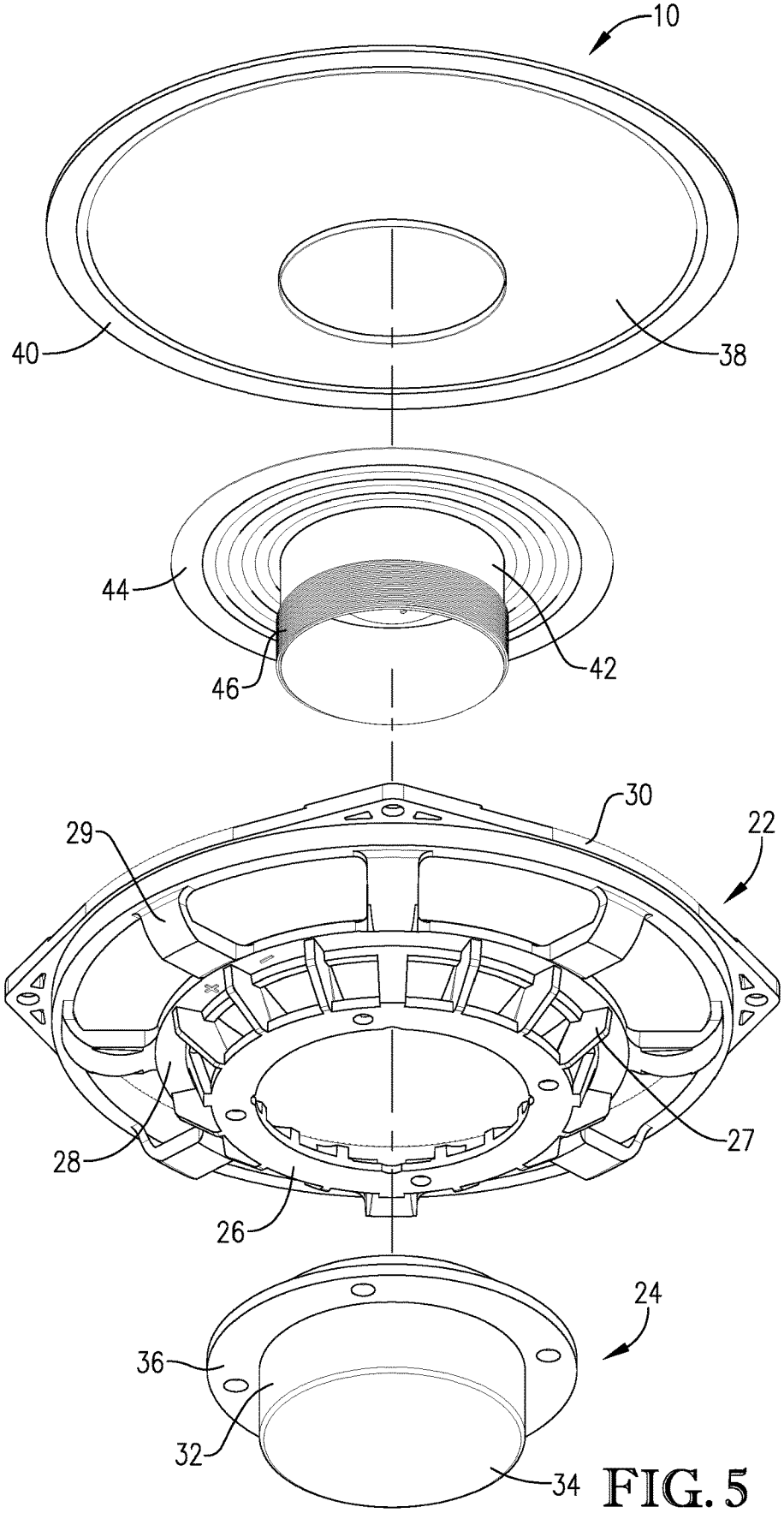
FIG. 5 is a lower perspective exploded view of the coaxial loudspeaker of FIG. 1.

The low frequency driver 14, also known as a "woofer", is configured to generate low frequency sound relative to the high frequency driver 16. The low frequency driver 14 includes a first diaphragm 38, a first surround 40, a first collar 42, a first spider 44, and a first voice coil 46. The first diaphragm 38 is generally frustoconical and includes a circumferentially-extending radially-inner edge and a circumferentially-extending radially-outer edge. The first diaphragm 38 has a generally shallow, low-profile shape, wherein the radial distance from the inner edge to the outer edge is greater than a height from a lower edge to an upper edge (at the outer edge). In addition, as shown in FIG. 3, the first diaphragm 38 may form an angle $\alpha$ with the central axis 20 that ranges from approximately 60 degrees to approximately 80 degrees. The first diaphragm 38 may be formed from rigid or semi-rigid materials.

The first surround 40 is generally annular and includes a circumferentially-extending radially-inner edge and a circumferentially-extending radially-outer edge. The first surround 40 is connected to the first diaphragm 38 with the radially-inner edge of the first surround 40 being adjacent the radially-outer edge of the first diaphragm 38. The first surround 40 is also connected to the third ring 30 with the radially-outer edge of the first surround 40 being adjacent the third ring 30. The first surround 40 may be formed from flexible materials.

The first collar 42, also known as a "former", forms a generally hollow cylindrical shape and includes an axially-forward edge. The first collar 42 is connected or fixed to the first diaphragm 38 with the radially-inner edge of the first diaphragm 38 being adjacent and/or connected to the axially-forward edge of the first collar 42. The first collar 42 may be formed from rigid materials. The first collar 42 is generally positioned concentric with the central axis 20.

The first spider 44 is generally annular and includes a circumferentially-extending radially-inner edge. The first spider 44 is connected to the first collar 42 with the radially-inner edge of the spider 44 adjacent and/or connected to the first collar 42. The first spider 44 also includes a circumferentially-extending radially-outer edge. The first spider 44 may be connected to the second ring 28 with the radially-outer edge of the first spider 44 being adjacent and/or connected to the second ring 28.

The first spider 44 may comprise semi-rigid or flexible materials. Between radially-inner and -outer edges, the first spider 44 may form or present a plurality of radially-spaced waves, ripples, or corrugations.

The first voice coil 46 includes a plurality of windings of electrically-conductive wire in a helical shape similar to a solenoid, wherein the wire is formed from copper, aluminum, or other metals or metal alloys. The wire may have a generally circular, generally square or rectangular, generally hexagonal, or other geometric cross-sectional shape. The first voice coil 46 is wrapped around, or mounted on, the first collar 42 and is positioned so that at least a portion of the windings is in contact with, and is fixed to, an outer surface of the first collar 42, near its axially-rearward edge (i.e., adjacent the first magnet 60, described in more detail below). Given that the first voice coil 46 and the first diaphragm 38 are each connected or fixed to the first collar 42, motion of the first voice coil 46 results in, or causes, motion of the first diaphragm 38.

Moreover, the first spider 44 generally circumscribes the first collar 42, preferably providing a relatively evenly-distributed radially-inward force that tends to center the first collar 42 and reduce radial motion of the first voice coil 46 while allowing axial motion. Similarly, the first surround 40 generally reduces or eliminates radial motion of the first diaphragm 38 while allowing axial motion.

The high frequency driver 16, also known as a "tweeter", is configured to generate high frequency sound relative to the low frequency driver 14. The high frequency driver 16 includes a second diaphragm 48, a cap 50, a waveguide 52, a second surround 54, a second collar 56, and a second voice coil 58. The second diaphragm 48 has a dome, partial spherical, or paraboloid shape and includes a circumferentially-extending radially-outer edge. The second diaphragm 48 may be formed from rigid materials.

The cap 50 also has a dome, partial spherical, or paraboloid shape and includes a circumferentially-extending radially-outer edge. The cap 50 may be formed from rigid or semi-rigid materials. The cap 50 further defines a plurality of perforations extending therethrough, the perforations forming concentric rings extending radially from a center of the cap 50. The cap 50 is axially forward of the second diaphragm 48 and provides a protective cover for the second diaphragm 48.

The waveguide 52 is generally annular with a circumferentially-extending radially-inner edge. The waveguide 52 is connected to the cap 50 with the radially-inner edge of the waveguide 52 being adjacent and/or connected to the radially-outer edge of the cap 50. In various embodiments, an upper edge of the waveguide 52 is roughly aligned with an upper edge of the second diaphragm 48. In addition, the waveguide 52 has a relatively shallow, low-profile cross-sectional shape, wherein the radial distance from the inner edge to the outer edge is greater than a height from a lower edge to the upper edge (at the outer edge). The waveguide 52 may be formed from rigid or semi-rigid materials.

The second surround 54 is generally annular with a circumferentially-extending radially-inner edge and a circumferentially-extending radially-outer edge. The second surround 54 is connected or fixed to the second diaphragm 48 with the radially-inner edge of the second surround 54 being adjacent and/or connected to the radially-outer edge of the second diaphragm 48. The second surround 54 may be formed from flexible materials. Between radially-inner and -outer edges, the second surround 54 may form or present at least one wave, ripple, or corrugation.

The second collar 56 forms a generally hollow cylindrical shape and includes an axially-forward edge. The second collar 56 is connected or fixed to the second diaphragm 48 with the radially-outer edge of the second diaphragm 48 being adjacent and/or connected to the axially-forward edge of the second collar 56. The second collar 56 is generally positioned concentric with the central axis 20.

The second voice coil 58 includes a plurality of windings of electrically-conductive wire in a helical shape similar to a solenoid, wherein the wire is formed from copper, aluminum, or other metals or metal alloys. The wire may have a generally circular, generally square or rectangular, generally hexagonal, or other geometric cross-sectional shape. The second voice coil 58 is wrapped around the second collar 56 and is positioned so that at least a portion of the windings is in contact with, and is fixed to, an outer surface of the second collar 56, near its axially-rearward edge. Given that the second voice coil 58 and the second diaphragm 48 are each connected or fixed to the second collar 56, motion of the second voice coil 58 results in motion of the second diaphragm 48.

Moreover, the second surround 54 generally circumscribes the second collar 56 and is configured to provide a relatively evenly-distributed radially-inward force when the second collar 56 moves in a radial direction away from a central position. Thus, the second surround 54 allows unimpeded axial motion of the second collar 56 while tending to reduce radial motion.

The magnetic circuit 18 is shared between the low frequency driver 14 and the high frequency driver 16 and provides a magnetic field through which the first voice coil 46 and the second voice coil 58 move. The magnetic circuit 18 includes a first magnet 60, a second magnet 62, a pole piece 64, and a plate 66. The magnetic circuit 18 further includes a portion of the cup 24.

The first magnet 60 and the second magnet 62 are each permanent magnets having a ring or annular shape and roughly the same dimensions, including inner diameter, outer diameter, and axial length or thickness. The first magnet 60 is positioned in contact with the bottom wall 34 of the cup 24. The second magnet 62 is axially spaced apart from, and forward of, the first magnet 60. The pole piece 64 includes a central axially-elongated ring 68 and a lower flange 70. The pole piece 64 may be formed from magnetically permeable material. The central ring 68 presents a cylindrical, axially-extending, radially outer margin or surface and a semi-elliptical, arcuate, or rounded inner surface.

The central ring 68 has a constant outer diameter and a variable inner diameter. The lower flange 70 is disc-shaped, is connected or fixed to a lower portion of the central ring 68, and extends radially outward therefrom. The pole piece 64 is positioned within the cup 24 such that a bottom or axially-rearward surface of the lower flange 70 is in contact with an upper or axially-forward surface of the first magnet 60. In addition, a lower or axially-rearward surface of the second magnet 62 is in contact with an upper or axially-forward surface of the lower flange 70.

The plate 66 has a ring or annular shape with a radially-inner diameter that is greater than the radially-outer diameter of the central ring 68. The plate 66 also has a radially-outer diameter approximately equal to the radially-outer diameters of the first magnet 60 and the second magnet 62. The plate 66 may be formed from magnetically permeable material. The plate 66 is positioned within the cup 24 such that a lower or axially-rearward surface of the plate 66 is in contact with, and connected to, an upper or axially-forward surface of the second magnet 62. The radially-outer surfaces or outer edges of the first magnet 60, the second magnet 62, the lower flange 70, and the plate 66 are substantially aligned with one another.

In addition, there is space between the radially-outer surfaces of the first magnet 60, the second magnet 62, the lower flange 70, and the plate 66 on the one hand, and the radially-inner surface of the side wall 32 of the cup 24 on the other hand. Namely, there is a first magnetic gap 72 between the radially-outer surface of the lower flange 70 and the radially-inner surface of the side wall 32. The first voice coil 46 is positioned in the first magnetic gap 72. Moreover, there is a second magnetic gap 74 between the radially-outer surface of the central ring 68 and the radially-inner surface of the plate 66. The second voice coil 58 is positioned in the second magnetic gap 74.

Referring to FIG. 7 and the magnetic circuit 18, the first magnet 60 and the second magnet 62 are oriented such that the same magnetic poles face each other across the lower flange 70. For example, taken in an axial direction, the south magnetic pole of the first magnet 60 faces the south magnetic pole of the second magnet 62. In embodiments of the present invention, however, the north magnetic pole of the first magnet 60 may face the north magnetic pole of the second magnet 62, again taken in an axial direction.

The first magnet 60 generates a first magnetic field, and the second magnet 62 generates a second magnetic field. The lines of magnetic flux of the two magnetic fields are mostly contained within the magnetic circuit 18. That is, magnetic flux lines generated from the south magnetic poles of the two magnets 60, 62 flow into the lower flange 70 of the pole piece 64. A portion of the magnetic flux lines flow across the first magnetic gap 72 through the first voice coil 46 and into the side wall 32 of the cup 24. A portion of the magnetic flux lines flow through the side wall 32 upward or axially-forward, into the plate 66, and to the north magnetic pole of the second magnet 62. A portion of the magnetic flux lines flow through the side wall 32 downward or axially-rearward, into the bottom wall 34, and to the north magnetic pole of the first magnet 60. A portion of the magnetic flux lines flow through the central ring 68 across the second magnetic gap 74 through the second voice coil 58, into the plate 66 and to the north magnetic pole of the first magnet 60.

In an embodiment, at least 10%, 15%, 20%, 25%, or 30% of the magnetic flux generated respectively by the first and second magnets 60, 62 flows through the second magnetic gap 74. Further, in an embodiment, at least 50%, 60%, 70%, 75%, 80%, or 85%, but not more than 90%, of the magnetic flux generated respectively by the first and second magnets 60, 62 flows through the first magnetic gap 72.

In various embodiments, approximately 70% of the magnetic flux generated by the first magnet 60 and approximately 70% of the magnetic flux generated by the second magnet 62 flow through the first magnetic gap 72. Approximately 30% of the magnetic flux generated by the first magnet 60 and approximately 30% of the magnetic flux generated by the second magnet 62 flow through the second magnetic gap 74.

The coaxial loudspeaker 10 may operate as follows. An audio electronic signal is provided to the coaxial loudspeaker 10. Typically, the coaxial loudspeaker 10 also includes an electronic circuit that filters the audio signal and generates a low frequency audio electronic signal, which has high frequency components filtered out, and a high frequency audio electronic signal, which has low frequency components filtered out. The low frequency audio signal is communicated to the first voice coil 46, while the high frequency audio signal is communicated to the second voice coil 58.

The voice coils 46, 58 are respectively positioned within the magnetic gaps 72, 74 through which magnetic field lines flow. Electric currents respectively flowing through the voice coils 46, 58 cause mechanical forces to be exerted on the voice coils 46, 58, in each case transverse to the flow of the magnetic field lines. The forces cause the voice coils 46, 58 to move axially. As the electric currents change direction of flow according to the frequency contents of the audio signals, the voice coils 46, 58 oscillate axially. Motion of the first voice coil 46 causes motion of the first diaphragm 38 which generates the low frequency sound content of the audio signal. Motion of the second voice coil 58 causes motion of the second diaphragm 48 which generates the high frequency sound content of the audio signal.

Typically, coaxial loudspeakers include one magnetic circuit for each driver, wherein each magnetic circuit includes one magnet to generate the magnetic field in which the voice coil of each driver is positioned. At least one advantage embodiments of the current invention have over typical coaxial loudspeakers is that the coaxial loudspeaker 10 includes a single magnetic circuit 18 to serve both the low frequency driver 14 and the high frequency driver 16. The magnetic circuit 18 includes two magnets 60, 62 that generate the magnetic field in which the voice coil of each driver is positioned. The two magnets 60, 62 generate a greater magnetic field than a single magnet would, for each voice coil 46, 58, which improves the efficiency of the coaxial loudspeaker 10 and provides greater performance characteristics.

Another advantage that embodiments of the current invention have is the waveguide structure the coaxial loudspeaker 10 includes for the high frequency driver 16. The coaxial loudspeaker 10 includes the waveguide 52 surrounding the second diaphragm 48 of the high frequency driver 16. The waveguide 52 includes an upper surface with an arcuate shape. The waveguide 52 is positioned between the first diaphragm 38 and the second diaphragm 48. The outer edge of the waveguide 52 generally aligns with the inner edge of the first diaphragm 38 of the low frequency driver 14 and the upper surface of the waveguide 52 generally aligns with the upper surface of the first diaphragm 38. With this structure and alignment, the waveguide 52 and the first diaphragm 38 act in combination to form a larger-sized acoustic waveguide for the high frequency driver 16—thus providing the benefit of better matching the acoustic dispersion of the low frequency driver 14 at lower frequencies generated by the high frequency driver 16. The combination of the waveguide 52 and the first diaphragm 38 has a generally oblate spheroid shape, resulting from the low-profile, shallow waveguide 52 and the shallow pitch of the conical shape of the first diaphragm 38, which forms the angle $\alpha$ with the central axis 20 ranging from approximately 60 degrees to approximately 80 degrees. These factors provide better waveguide characteristics for the high-frequency driver 16.

Other advantages that embodiments of the current invention offer are that having a single magnetic circuit 18 to serve both the low frequency driver 14 and the high frequency driver 16 is more compact than having a magnetic circuit for each of the low frequency driver 16 and the high frequency driver 18. Moreover, in a preferred embodiment, the distance from the first voice coil 46 to the lower, inner edge of the first diaphragm 38 is reduced, thereby reducing the length of the first collar 42. The relatively shorter first collar 42 improves the performance of the low frequency driver 14. In addition, a single magnetic circuit 18 that serves both the low frequency driver 14 and the high frequency driver 16 requires fewer components and makes more efficient use of the magnets 60, 62. Furthermore, a single magnetic circuit 18 that serves both the low frequency driver 14 and the high frequency driver 16 allows for the low frequency driver 14 and the high frequency driver 16 to be placed closer to one another, which improves the sound wave phase alignment between the low frequency driver 14 and the high frequency driver 16 and is beneficial for acoustic performance.

Additional Considerations

Throughout this specification, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A coaxial loudspeaker comprising:

a low frequency driver configured to generate low frequency sounds, the low frequency driver including a first voice coil;

a high frequency driver coaxially aligned with the low frequency driver and configured to generate high frequency sounds relative to the low frequency driver, the high frequency driver including a second voice coil; and a magnetic circuit shared by the low frequency driver and the high frequency driver, the magnetic circuit including a cup including a hollow cylindrical side wall and a circular bottom wall connected to one end of the side wall, a first magnet configured to generate a first magnetic field, the first magnet positioned within the cup in contact with the bottom wall, a second magnet configured to generate a second magnetic field, the second magnet positioned within the cup axially spaced apart from the first magnet, a pole piece positioned within the cup, the pole piece including a central ring and a lower flange connected to the central ring and extending radially outward, the central ring positioned radially inward from the second magnet, a plate having a ring shape and positioned within the cup in contact with the second magnet and radially outward from the central ring, a first magnetic gap in which the first voice coil is positioned, the first magnetic gap located between the lower flange and the side wall of the cup, and a second magnetic gap in which the second voice coil is positioned, the second magnetic gap located between the central ring and the plate.

2. The coaxial loudspeaker of claim 1, wherein approximately 70% of a magnetic flux generated by each magnet flows through the first magnetic gap and approximately 30% of the magnetic flux generated by each magnet flows through the second magnetic gap.

3. The coaxial loudspeaker of claim 2, wherein the magnetic flux generated by the first magnet and the second magnet flows through the side wall, a portion of the bottom wall, the pole piece, and the plate and across the first magnetic gap and the second magnetic gap.

4. The coaxial loudspeaker of claim 1, wherein the first magnet and the second magnet each have roughly the same shape and roughly the same dimensions.

5. The coaxial loudspeaker of claim 1, wherein the central ring includes a flat outer surface and a rounded inner surface.

6. The coaxial loudspeaker of claim 1, wherein the low frequency driver further includes:

a first collar on which the first voice coil is mounted, a first diaphragm frusto-conically shaped and connected to the first collar such that motion of the first voice coil causes motion of the first diaphragm, a first surround configured to reduce radial motion of the first diaphragm, and a first spider configured to reduce radial motion of the first collar.

7. The coaxial loudspeaker of claim 1, wherein the high frequency driver further includes:

a second collar on which the second voice coil is mounted, a second diaphragm dome shaped and connected to the second collar such that motion of the second voice coil causes motion of the second diaphragm, and a second surround configured to reduce radial motion of the second diaphragm and the second voice coil.

8. A coaxial loudspeaker comprising:

a low frequency driver configured to generate low frequency sounds, the low frequency driver including a first voice coil, a first collar on which the first voice coil is mounted, a first diaphragm frusto-conically shaped and connected to the first collar such that motion of the first voice coil causes motion of the first diaphragm, a first surround configured to reduce radial motion of the first diaphragm, and a first spider configured to reduce radial motion of the first collar, a high frequency driver coaxially aligned with the low frequency driver and configured to generate high frequency sounds relative to the low frequency driver, the high frequency driver including a second voice coil, a second collar on which the second voice coil is mounted, a second diaphragm dome shaped and connected to the second collar such that motion of the second voice coil causes motion of the second diaphragm, and a second surround configured to reduce radial motion of the second diaphragm and the second voice coil; and a magnetic circuit shared by the low frequency driver and the high frequency driver, the magnetic circuit including a cup including a hollow cylindrical side wall and a circular bottom wall connected to one end of the side wall, a first magnet configured to generate a first magnetic field, the first magnet positioned within the cup in contact with the bottom wall, a second magnet configured to generate a second magnetic field, the second magnet positioned within the cup axially spaced apart from the first magnet, a pole piece positioned within the cup, the pole piece including a central ring and a lower flange connected to the central ring and extending radially outward, the central ring positioned radially inward from the second magnet, a plate having a ring shape and positioned within the cup in contact with the second magnet and radially outward from the central ring, a first magnetic gap in which the first voice coil is positioned, the first magnetic gap located between the lower flange and the side wall of the cup, and a second magnetic gap in which the second voice coil is positioned, the second magnetic gap located between the central ring and the plate.

9. The coaxial loudspeaker of claim 8, wherein approximately 70% of a magnetic flux generated by each magnet flows through the first magnetic gap and approximately 30% of the magnetic flux generated by each magnet flows through the second magnetic gap.

10. The coaxial loudspeaker of claim 9, wherein the magnetic flux generated by the first magnet and the second magnet flows through the side wall, a portion of the bottom wall, the pole piece, and the plate.

11. The coaxial loudspeaker of claim 8, wherein the first magnet and the second magnet each have roughly the same shape and roughly the same dimensions.

12. The coaxial loudspeaker of claim 8, wherein the central ring includes a flat outer surface and a rounded inner surface.

* * * * *